United States Patent [19]

Suters

[11] Patent Number: 4,654,990

[45] Date of Patent: Apr. 7, 1987

[54] DOUBLE FACE CHANGEABLE SIGN

[76] Inventor: Everett T. Suters, 501 Peachtree Battle Ave., N.W., Atlanta, Ga. 30305

[21] Appl. No.: 801,230

[22] Filed: Nov. 25, 1985

[51] Int. Cl.[4] ..... G09F 11/00

[52] U.S. Cl. ..... 40/491; 40/488

[58] Field of Search ..... 40/491, 5, 488, 490; 434/405

[56] References Cited

U.S. PATENT DOCUMENTS

| | | | |
|---|---|---|---|
| 3,748,767 | 7/1973 | Giesecke | 40/491 |
| 3,769,727 | 11/1973 | Kent, Jr. | 40/488 |
| 4,217,713 | 8/1980 | Greenberger | 40/491 |
| 4,485,576 | 12/1984 | Greenberger | 40/491 |

FOREIGN PATENT DOCUMENTS

| | | | |
|---|---|---|---|
| 206913 | 11/1923 | United Kingdom | 40/488 |
| 441846 | 1/1936 | United Kingdom | 40/491 |

*Primary Examiner*—Gene Mancene
*Assistant Examiner*—Cary E. Stone
*Attorney, Agent, or Firm*—Thomas & Kennedy

[57] ABSTRACT

The sign envelope (12) is formed by parallel side panels (14 and 15), with openings (24 and 25) formed in each side panel. The openings are positioned at opposite ends of the envelope, and messages (28, 29) opposite in meaning are displayed by each side panel (14, 15) through the opening (24, 25) of the other panel. Sign plate (26) bears messages (30, 31) opposite in meaning on its opposite surfaces. Sign plate (26) is slidable through the envelope to register with one or the other of the openings (24, 25) of the envelope to display one of its messages which is compatible with the uncovered message at the opposite end of the envelope.

6 Claims, 7 Drawing Figures

DOUBLE FACE CHANGEABLE SIGN

FIELD OF THE INVENTION

This invention relates to a sign for placement against a glass wall or door, etc., which can be viewed from both sides, and which can be changed to exhibit different messages on both sides.

BACKGROUND OF THE INVENTION

In the circumstances where a merchant or other business person wishes to display a message through a glass door or wall or other transparent surface, it is sometimes desirable to have a sign that displays identical or compatible messages on both sides of the sign. Moreover, it is sometimes desirable to have a sign that can be changed so as to display alternate messages. For example, a double face, changeable sign is desirable to indicate that a store is "open" or "closed". Such signs might be applied to the glass entrance door of a retail store.

It would be desirable to have a double face, changeable sign that exhibits the same or compatible messages on both faces of the sign, but which can be changed so as to exhibit alternate but compatible messages on both of its faces. For example, a double face, changeable sign might include the message "Open" to be exhibited through the glass entrance door to the outside of a retail store, while the inside surface of the sign might exhibit the compatible message "Thanks, call again." When the store is to be closed, the merchant can change the sign so that it displays through the glass to the outside of the store the message "Closed", and to the inside: "Cut off lights before leaving." In some instances the message exhibited to both sides of the sign might be identical.

SUMMARY OF THE INVENTION

Briefly described, the present invention comprises a double face, changeable sign suitable for use in a retail store, or in other type environments, whereby duplicate or compatible messages are to be exhibited on both sides of a transparent door, window, etc., and whereby the sign can be changed to exhibit alternate compatible messages.

The sign includes a sign envelope having a pair of side panels mounted in juxtaposed, overlying parallel relationship, with the side panels each defining an opening therethrough, with the openings being out of alignment with each other. A sign plate is slidably mounted between the side panels of the sign envelope and is movable into and out of registration with the openings. A first message is applied to each side panel of the sign envelope and is in alignment with the opening of the other side panel for display therethrough when the sign plate is not obstructing the message. The sign plate bears its own messages, and when the sign plate is moved into alignment with one of the openings in a side panel, its message is visible through the opening.

The unmoveable messages that are applied to the side panels and are exhibited through the openings of the other side panels are opposite in compatibility, such as "Open" versus "Closed". Likewise, the messages on opposite sides of the moveable sign plate are opposite in compatibility. The sign plate is oriented in the envelope so that when it is moved into registration with one of the two openings of the envelope, it will display a message that is compatible with the message that has been uncovered by the sign plate and is displayed through the opposite window. Therefore, the sign assembly will always display compatible messages in opposite directions.

Thus, it is an object of this invention to provide a sign assembly for use in a retail store and other locations where it can be mounted to a transparent door, window, etc. for displaying compatible messages on its opposite sides, and whereby the sign can be changed to indicate alternate compatible messages on both sides of the sign.

Another object of this invention is to provide an inexpensive changeable double face sign which exhibits messages on both of its sides, which is suitable for mounting to a transparent surface, and which can be changed at will to indicate alternate messages on both sides.

Other objects, features, and advantages of the present invention will become apparent upon reading the following specifications, when taken in conjunction with the accompanying drawings.

DETAILED DESCRIPTION

Figure 7:
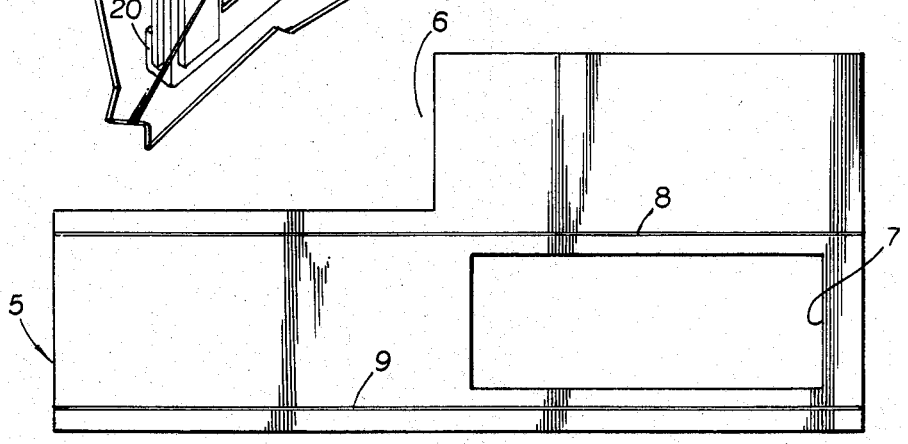
FIG. 7 illustrates the envelope of the double faced changeable sign after it has been cut to shape but before it has been folded into its useable configuration.

Referring now in more detail to the drawings, in which like numerals indicate like parts throughout the several views, FIG. 7 illustrates the sign envelope 12 after it has been cut but before it has been folded into its useable configuration. In general, the envelope is formed from a single sheet of thermoplastic materials which is rectangular except for the cutout notch 6 at one corner thereof. Also, an opening or window 7 is cut through the lower portion of the envelope blank 5. Fold lines 8 and 9 are to be formed parallel to each other and on opposite sides of window 7. The final envelope is formed by folding along fold lines 8 and 9.

Figure 1:
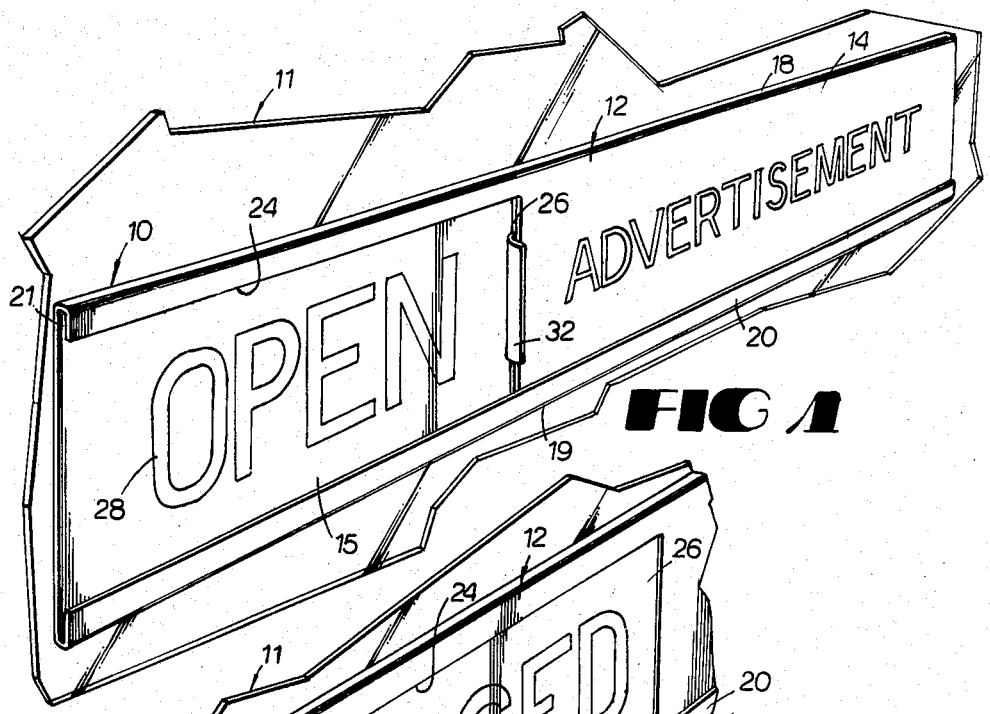
FIG. 1 is a perspective illustration of the front face of the double face changeable sign as applied to the near surface of a transparent wall, door, etc.

As illutrated in FIG. 1, the double faced changeable sign 10 is illustrated as being applied to the near side of a transparent wall, door, etc., such as a door of sheet glass at the entrance of a retail store. The sign assembly includes the elongated sign envelope 12 that is formed by the blank 5 of material illustrated in FIG. 7, and includes a pair of side panels 14 and 15 mounted in juxtaposed overlying parallel relationship. The single sheet 5 of thermoplastic material is folded along its fold lines 8 and 9 so as to form a top folded edge 18 and a bottom folded edge 19. The bottom fold forms a lower flange 20 which engages the lower edge of side panel 14 and retains the side of panel 14 in parallel relationship with respect to side panel 15. The folds of top and bottom folded edges 18 and 19 are formed so as to maintain the side panels 14 and 15 in spaced relationship with respect to each other, thereby forming a sign plate passage 21 therebetween. The sign plate passage 21 is open from end-to-end through the elongated sign envelope 22, and a sign plate 26 is inserted in sliding relationship in the sign plate passage 21.

Openings or windows are formed on opposite sides of the sign envelope 12. Opening 24 is formed by notch 6 of the blank 5 and lower flange 20 and is located at one end portion of envelope 12 and is formed in side panel 14, whereas opening 25 is formed from cutout 7 of the blank 5 and is located in side panel 15 at the other end portion of the envelope. Opening 24 extends through the end of side panel 14, while opening 25 is defined on all four sides by side panel 15. The openings do not register with each other.

Figure 4:
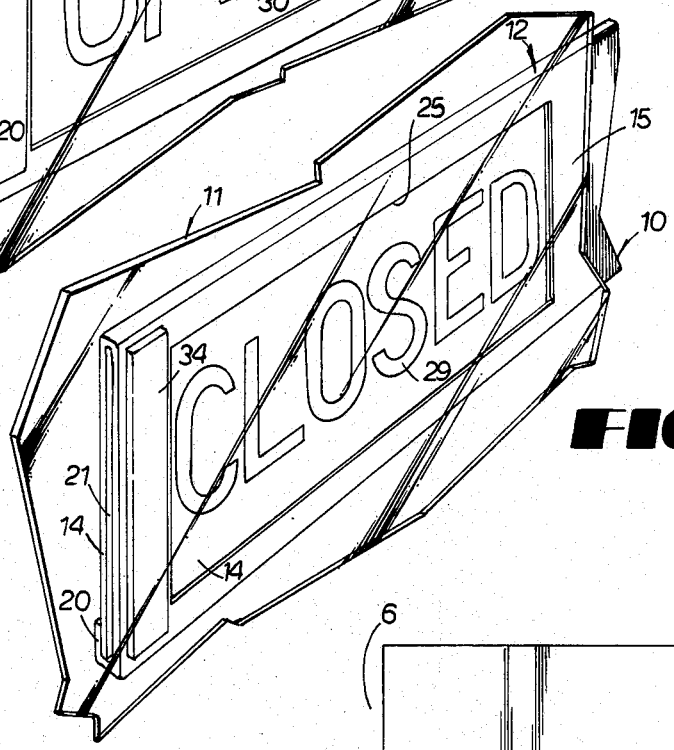
FIG. 4 is a partial perspective illustration of the left portion of the back face of the sign of FIG. 3, showing the sign mounted on the other side of the transparent wall, with the sign plate moved to the alternate position.

A first message 28 (FIG. 1) such as "Open" is applied to the surface of side panel 15 that faces opening 24 and is in visual alignment with opening 24. A second message 29 (FIG. 4) such as "Closed" is applied to side panel 14 and faces opening 25 and also is in visual registration with side panel 15. First and second messages 28 and 29 are not compatible in meaning.

Figure 2:
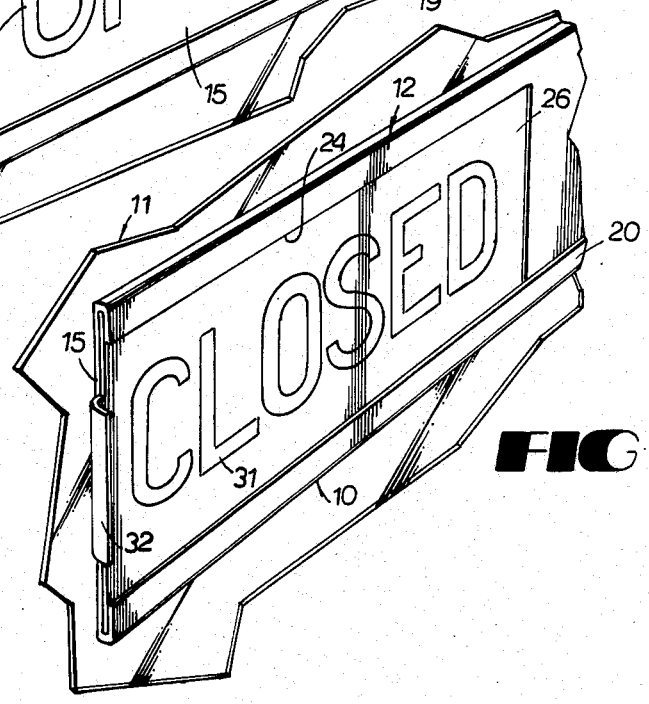
FIG. 2 is a partial pderspective illustration of the left portion of the double face sign in FIG. 1, but showing the sign having its sign plate moved in the alternate position.
Figure 5:
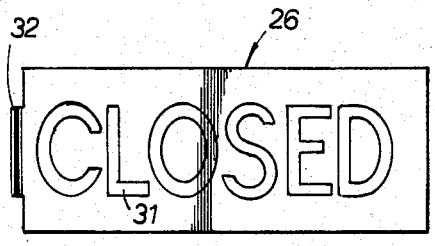
FIGS. 5 and 6 are front and back views of the sign plate, respectively.
Figure 6:
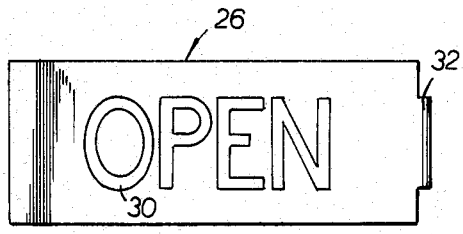
Figure 3:
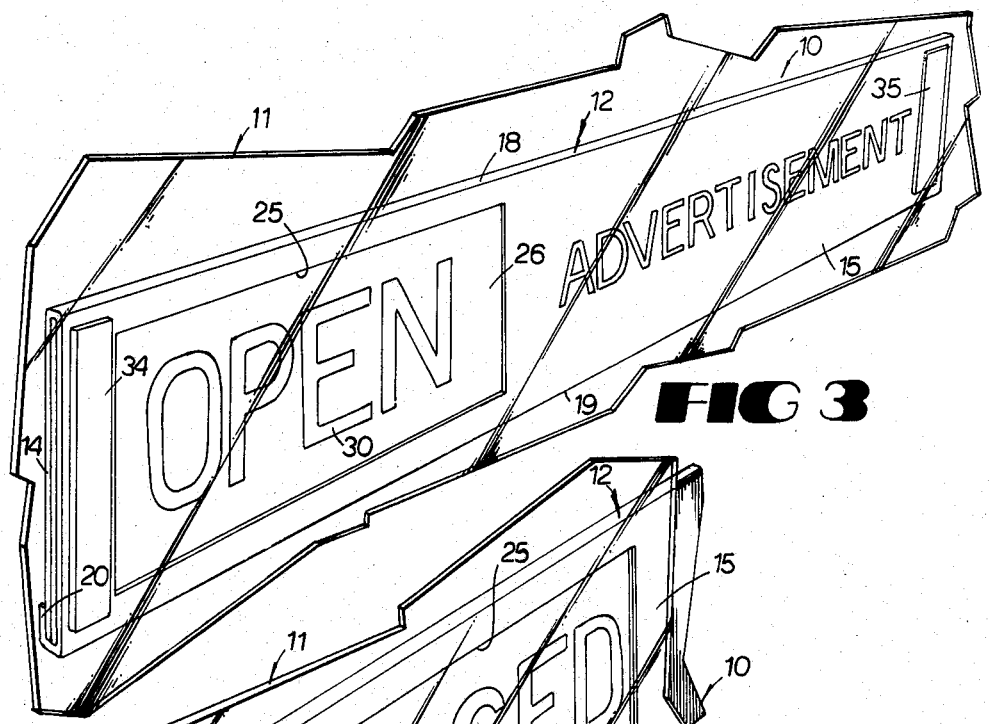
FIG. 3 is a perspective illustration of the back face of the double face changeable sign of FIGS. 1 and 2, but showing how the sign is mounted to the other side of the transparent wall.

As illustrated in FIGS. 3 and 6, sign plate 26 has a first message 30 such as "Open" which is the same or at least compatible with respect to the message 28, whereas the other surface of sign plate 26 (FIGS. 2 and 5) includes a second message 31 such as "Closed" that is the same or at least compatible with the second message 29 of the sign envelope. The material of the otherwise flat sign plate 26 is bent at one end to form a finger pull tab 32, which can be used to grasp with a finger so as to assist in sliding sign plate 26 along the length of sign envelope 12.

As illustrated in FIG. 3, double faced adhesive strips 34 and 35 are applied to the end portions of side panel 15 at opposite ends of the sign envelope, for the purpose of mounting the envelope to the transparent wall, etc. It will be noted that finger tab 32 projects through the opening 24 that faces away from the wall surface 11.

When the double faced changeable sign 10 is applied to a transparent surface and the sign plate 26 is in the position as indicated in FIGS. 1 and 3, the sign plate 26 is located generally out of registration with opening 24 of side panel 14 so that the first message "open" which is present on the facing surface of side panel 15 is displayed through opening 24. In the meantime, the same or compatible message 30 which is present on sign plate 26 is located in registration with the other opening 25 (FIG. 3) which is formed in side panel 15. Therefore, sign plate 26 obscures message 29 and displays its own message 30. This presents the same or compatible messages on both surfaces of the sign.

When the sign plate 26 is moved to its other position (FIGS. 2 and 4) by sliding it along its passage 21 in the envelope 12, the message 28 (FIG. 1) will be blocked or obscured by the sign plate (FIG. 2), and the alternate message 31 on the face of the sign plate will register with opening 24. In the meantime, the movement of sign plate 26 to this alternate position will withdraw the sign plate 26 from opening 25 (FIG. 4), so that the second message 29 of the side panel 14 is displayed through opening 25 of side panel 15. Therefore, the alternate but compatible messages 29 and 31 will be displayed on opposite sides of the sign assembly.

Although the opening 24 formed in side panel 14 is illustrated as being a slot or cutout extending from the margin of the single sheet of thermoplastic material, it will be understood that this opening can be formed as a hole cut through the sheet material, similar to the opening 25. When initially assembling the sign plate with the envelope, the envelope can be compressed and bowed open to admit the finger tab 32 of the sign plate. In the alternative, the finger tab 32 can be omitted from the design and a separate finger tab attached to the sign plate after the sign plate has been inserted in the envelope.

In addition, while the openings 14 and 15 have been illustrated as cutout windows in the side panels of the envelope 12, it is within the perview of this invention to provide transparent windows in these portions of the envelope instead of cutout openings.

Although the messages illustrated in the drawings are simply "open" and "closed", it will be understood by those skilled in the art that the messages to be displayed simultaneously on opposite sides of the sign are intended to be compatible if not identical, such that the face of the sign facing through the glass door of a retail store might simply say "open", while the compatible message facing the inside of the store might say "thank you" or "step down". Likewise, the alternate but compatible messages might say "closed" and "set the alarm". In either case, a person that observes the sign from inside the store will understand from the observed message on the inside of the store what the message is that is displayed to the outside.

It should be understood that the just described embodiment merely illustrates principles of the invention in a preferred form. Many other modifications, additions and deletions may be made thereto without departure from the spirit and scope of the invention as set forth in the following claims.

I claim:

1. A double face changeable sign for mounting to a transparent wall or the like for exhibitng messages to both sides of the wall comprising an elongated sign envelope including a pair of side panels mounted in juxtaposed overlying parallel relationship and defining a sign plate passage therebetween, the first of said side panels defining an opening adjacent one end portion of said envelope, the second of said side panels defining an opening adjacent the other end portion of said envelope, said first side panel having a first visible message in visible alignment with the opening of said second side panel, said second side panel having a second visible message in visible alignment with the opening of said first side panel, a sign plate positioned in said sign plate passage, said sign plate being of a length shorter than said envelope and also having the first and second visible message applied on opposite sides thereof with its first visible message facing in a direction opposite to the direction in which the first visible message of said first side panel faces and having its second visible message facing in a direction opposite to the direction in which the second visible message of said second side panel faces, whereby when the sign plate is moved in the sign plate passage to one end portion of the envelope the sign plate moves out of registration with the opening of the second side panel and into visible registration with the opening of the first side panel and blocks the view of the second message on the second side panel and displays its first message through the opening of the first side panel, but when the sign plate is moved in the sign plate passage to the other end portion of the envelope the sign plate moves out of registration with the opening of the first side panel and into visible registration with the opening of the second side panel and blocks the view of the first message on the first side panel and displays its second message through the opening of the second side panel, so that similar messages are always displayed simultaneously on both sides of the sign and are changed when the sign plate is moved from one end portion to the other end portion of the sign envelope.

2. The sign of claim 1 and wherein said sign plate includes a tab protruding thereform and extending through one of said side panel openings.

3. The sign of claim 1 and wherein said first visible messages include a word indicating "open" and said second visible messages include a word indicating "closed".

4. The sign of claim 1 and further including means for mounting said envelope to a transparent wall or the like.

5. The sign of claim 5 and wherein said means for mounting said envelope to a transparent wall or the like comprises adhesive applied to opposite end portions of said envelope.

6. A double faced changeable sign for mounting to a transparent wall or the like for exhibiting compatible messages on both sides of the wall comprising a sign envelope formed of first and second overlying side panels, an opening formed in each of said side panels with the openings being out of registration with each other, a first message carried by said first side panel in registration with the opening of said second side panel, a second message carried by said second side panel in registration with the opening of said first side panel, a sign plate slidably positioned between said side panels, said sign plate being of a size and shape to register with and cover the opening of one of said side panels but leaving the opening of the other of said side panels uncovered, said sign plate having first and second messages on opposite faces thereof with the first message on the side thereof facing in the direction opposite to the direction in which the first message of the first side panel faces and the second message on the side thereof facing in the direction opposite to the direction in which the second message of the second side panel faces, with the first message of said first side panel being compatible with the first message of said sign plate, and with the second message of said second side panel being compatible with the second message of said sign plate.

* * * * *